US005093073A

United States Patent [19]

Schenker

[11] Patent Number: 5,093,073

[45] Date of Patent: Mar. 3, 1992

[54] PROCESS FOR THE DECONTAMINATION OF SURFACES

[75] Inventor: Erhard Schenker, Kirchdorf, Switzerland

[73] Assignees: ABB Reaktor GmbH, Mannheim, Fed. Rep. of Germany; Paul Scherrer Institut, Würlingen, Switzerland

[21] Appl. No.: 397,440

[22] PCT Filed: Sep. 28, 1988

[86] PCT No.: PCT/EP88/00870

§ 371 Date: Jul. 7, 1990

§ 102(e) Date: Jul. 7, 1990

[87] PCT Pub. No.: WO89/03113

PCT Pub. Date: Apr. 6, 1989

[30] Foreign Application Priority Data

Oct. 2, 1987 [CH] Switzerland ..... 3846/87

[51] Int. Cl.[5] ..... G21C 19/42

[52] U.S. Cl. ..... 376/310; 376/306; 376/309; 376/305; 376/313

[58] Field of Search ..... 376/309, 310, 313, 305, 376/306; 204/149; 134/131; 252/634, 635; 502/516

[56] References Cited

U.S. PATENT DOCUMENTS 3,615;817 10/1971 Jordan ..... 376/309
4,217,192 8/1980 Lerch et al. ..... 204/149
4,481,040 11/1984 Brookes et al. ..... 134/3
4,522,928 6/1985 McVicker et al. ..... 502/26
4,913,849 4/1990 Husain ..... 252/626

OTHER PUBLICATIONS

Decontamination of Pressurized Water Reactors. PCT WO84/03170.

*Primary Examiner*—Donald P. Walsh
*Assistant Examiner*—Meena Chelliah
*Attorney, Agent, or Firm*—Herbert L. Lerner; Laurence A. Greenberg

[57] ABSTRACT

In this decontamination process, the surfaces contaminated with radioactive substances, in particular on components of cooling circuits in nuclear reactors, are treated in a first treatment step with an aqueous decontamination solution, containing chromic acid and permanganic acid, at a temperature in the range from 270 to 350 K, in particular at usual room temperature. The contaminated surface layers are thus oxidized by means of the permanganic acid, while the effect of the chromic acid is that the modified surface layers do not adhere firmly. In a second treatment step, the surface layers thus modified are removed by a chemical treatment in the same temperature range, as a result of dissolution, or/and removed by mechanical or hydraulic action. Aqueous solutions of organic acids are suitable for the chemical treatment in the second treatment step, it also being advantageously possible to add reducing agents and complexing agents and/or corrosion inhibitors.

19 Claims, No Drawings

PROCESS FOR THE DECONTAMINATION OF SURFACES

The invention relates to a process for the decontamination of surfaces, in particular on components of cooling circuits of nuclear reactors, by treatment of the radioactively contaminated surface layers with an aqueous, acid-containing decontamination solution.

In the cooling circuits of nuclear reactors, layers in which radioactive contaminants such as, for example, activated corrosion products, and also fission products, are incorporated are formed on the surfaces of the cooling circuit components. With increasing age of the nuclear power stations, this leads to an increase in the activity, the proportion of longer-lived nucleides rising in particular. With increasing age of the nuclear power stations, however, maintenance work and repairs must also be carried out more frequently and modifications must be made, so that the radiation exposure of the personnel increases. In order to facilitate work on radioactively contaminated plants or even to make it possible, decontaminations are necessary. The contaminated surface layers must then be removed as completely as possible, but the base materials of the cooling circuit components must be protected.

The composition of the surface layers does not have to be the same as that of the materials of the cooling circuit components. Physical conditions and water chemistry determine the corrosion of the materials and the transport and deposition of the resulting corrosion products and hence the composition and structure of the surface layers. For example under the conditions of a pressurized water reactor (PWR), oxide layers of high chromium content with spinel-type mixed oxides, which dissolve only extremely slowly in acids, form at a temperature of about 570 K in cooling water containing boric acid and lithium hydroxide.

All known processes for the decontamination of the surfaces of components of pressurized water reactors therefore comprise two or more treatment steps, the insoluble Cr(III) oxide being converted in a first step in an oxidizing phase into soluble 6-valent chromium, and the entire oxide layer being loosened at the same time. In a second treatment step, in most cases after intermediate rinsing, the loosened oxide layer is then dissolved in an acidic, reducing and complex-forming solution and removed.

For the first treatment step, that is to say the oxidative treatment step, a number of processes are usual, such as, for example, the so-called "AP" processes which consist of a treatment with alkaline permanganate solution, or the "NP" processes in which nitric acid solutions are used for the oxidation. Further known processes envisage the use of permanganic acid, hydrogen peroxide, cerium(IV) salts or other oxidizing agents. The current state of the art is extensively described, for example, in the following two publications:

(1) "Decontamination of Nuclear Facilities to Permit Operation, Inspection, Maintenance, Modification or Plant Decommissioning", Technical Reports Series No. 249, International Atomic Energy Agency, Vienna 1985;

(2) W. Morell, H. O. Bertold, H. Operschall and K. Fröhlich: "Dekontamination - Stand der Technik und aktuelle Entwicklungsziele [Decontamination State of the Art and Current Development—Targets]", VGB Kraftwerkstechnik 66 (1986) 579-588.

All the known processes have the common feature that they must be employed at relatively high temperatures, in most cases between 350 K. and 400 K. This involves various serious disadvantages, such as the necessity of relatively expensive and complicated auxiliary equipment, an increase in corrosivity, pressure build-up due to steam at treatment temperatures above 370 K., and others.

Attempts have therefore already been made on various occasions to develop oxidation treatments which work satisfactorily at lower temperatures, preferably at usual room temperature. As an example, a Swedish process may be mentioned here, in which the oxidation is carried out by means of ozone-containing nitric acid. This process has, however, the disadvantage that control of a process with a gas-containing liquid as the reagent is difficult and that ozone is not easy to handle and, in addition, is toxic and moreover can lead to explosions.

A further serious disadvantage of all the processes mentioned is the use of chemicals which contain elements which occur neither in the materials of the components which are to be decontaminated nor in the coolant. Since complicated components or entire cooling circuits of nuclear reactors can be completely flushed only with great difficulty and at considerable cost and thus be cleaned after the decontamination by removing all residues of the chemicals which have been introduced, it is unavoidable in practice that residues of such chemicals remain in the circuits and, under some circumstances, lastingly interfere with the further operation of the nuclear reactors, either as a result of depositions, local corrosion or of activation.

It is therefore the object of the present invention to provide a decontamination process which avoids the abovementioned disadvantages of known processes and which is effective at lower temperatures, even at usual room temperature, and manages with relatively harmless chemicals, the elements of which are not "foreign to the reactor" but are also usually present in the coolant and in the materials of the cooling circuit components.

This object is achieved by the process according to Patent Claim 1.

In the process according to the invention, the decontamination solution employed in the first treatment step contains chromic acid (chromium(VI) oxide) and permanganic acid. Both chromium and manganese are present as accompanying elements or alloy elements in all steels normally used in reactor construction. These chemicals are not only inexpensive but also relatively non-toxic and easy to handle in the concentrations employed.

The permanganic acid can preferably be prepared by passing an aqueous solution of an alkali metal permanganate or alkaline earth metal permanganate over a cation exchanger and thus forming the free acid which, after addition of chromic acid, is used as the decontaminating agent. Solutions of chromic acid and of salts of permanganic acid are also suitable as decontaminating agents; however, somewhat higher salt loads will then be obtained in the radioactive wastes due to the additionally introduced cation. The effectiveness of the decontaminating agent is characterized by the pH value and the redox potential of the solution. The first treatment step can therefore be monitored and controlled by means of these readily detectable measuring parameters.

As a result of the reaction of permanganic acid with constituents of the contaminated oxide layers and of spontaneous decomposition of the permanganic acid, insoluble manganese dioxide ("brown oxide") is formed even at usual room temperatures and precipitates on the surfaces. The discoloration allows a visual check of the effectiveness of the decontamination solution. Because of the presence of chromic acid in the decontamination solution, no firmly adhering layers form, which would afterwards be difficult to remove. The surfaces of the cooling circuit components cannot yet be completely freed of radioactive substances by the oxidative first treatment step, so that a second treatment step is additionally necessary for removing the surface layers which have been modified by the oxidative treatment.

The second treatment step can be of a chemical or physical nature. It has been found that the surface layers modified in the first treatment step, for example those of carbon steels, stainless chromium steels, nickel alloys and other materials usual in reactor construction, can be removed solely by mechanical and/or hydraulic action, for example by means of a high-pressure water jet, or chemically dissolved, in order to achieve complete decontamination. The chemical dissolution of the surface layers can be carried out with highly diluted solutions of organic acids, for example oxalic acid, citric acid or ascorbic acid, at usual room temperature, it also being possible in addition to add complexing agents and corrosion inhibitors to the solutions.

In order to minimize the volumes of the spent decontaminating agents, which are to be regarded as liquid radioactive wastes, it can be advantageous subsequently to add to the decontamination solution, employed in the first treatment step, further substances which make the solution suitable for use in the second treatment step. Possible such further substances are reducing agents, such as oxalic acid, ascorbic acid, formic acid and the like. The reducing agents have the effect that the chromic acid as well as the permanganic acid and its decomposition products, i.e. also the brown oxide, are converted into soluble chromium(III) salts and manganese(II) salts.

The success of the second treatment step can also be checked visually, since the brownish-red violet colored surface layers disappear from the decontaminated surfaces.

The efficiency of the decontamination solution employed in the first treatment step can be considerably enhanced by circulation, stirring or application of ultrasonics. The chemical removal of the modified surface layers in the second treatment step can also be accelerated by the same measures.

To enable the quantity of the particular solution required to be minimized, it is expedient to squirt or to spray it during the first treatment step and, if appropriate, also during the second treatment step onto the surface layers which are to be treated. It is also possible to apply the solution as a foam or thixotropic phase to the surfaces which are to be treated. Finally, a thickener can also be added to the solution which can then be applied as a coating directly to the surface layers which are to be treated.

It is clear that the chemical solutions consumed in the first and, if appropriate, in the second treatment step contain radioactive constituents and therefore require safe disposal. Disposal of solutions which contain chromic acid and permanganic acid or the decomposition products thereof is possible in various ways, the choice of the best approach in a particular case depending, on the one hand, on the potential further treatments of the decontaminated components and, on the other hand, also on the equipment present in the nuclear power station for the treatment of radioactive wastes. If the decontamination solution containing chromic acid and permanganic acid was used only for the oxidative first treatment step, it is advantageous for disposal to reduce the higher oxidation stages of the chromium and manganese by the addition of oxalic acid to chromium(III) salts and manganese(II) salts respectively. If the solution used in the oxidative first treatment step is subsequently to be used also for the second treatment step, the oxalic acid is directly added to the treatment solution, whereupon further chemicals, for example organic acids, complexing agents, corrosion inhibitors and the like, are then added for concluding the decontamination treatment. The chromium(III) salts and manganese(II) salts can be separated from the solutions thus reduced by chemical precipitations or solidified by evaporation and subsequent cementing to give products suitable for ultimate waste disposal.

The effectiveness of the process described, according to the invention, was tested on extensive sample material from the primary part of Swiss and foreign pressurized water reactors. Above all, radioactively contaminated samples consisting of the following materials were available:

a) plates of ferritic chromium steel (material no. 1.4001 according to DIN) from the seal of the manhole cover of steam generators;

b) plates and pipes of austenitic stainless steels;

c) steam generator tubes of iron/nickel/chromium alloys of the trade name INCOLOY 800 and of nickel/-chromium/ iron alloys of the trade name INCONEL 600. (INCOLOY and INCONEL are registered trademarks of International Nickel Company).

These samples a), b) and c) were contaminated mainly by the cobalt isotope $Co^{60}$.

EXAMPLE 1

The samples a) of ferritic chromium steel were treated at room temperature (290 K. to 295 K.) for 16 hours with a solution of 0.05 mol each of chromic acid and permanganic acid. After intermediate rinsing, a decontamination factor (ratio of measured activity before and after the treatment) of 2 was found. A further treatment at room temperature in an aqueous 0.1 mol solution of oxalic acid under the action of ultrasonics led to a decontamination factor of about 20 after 15 minutes and to a decontamination factor of more than 100 after 6 hours. After the treatment, the decontaminated surfaces of the samples were metallically bright and not noticeably attacked either macroscopically or microscopically.

EXAMPLE 2

Samples c) of nickel/chromium/iron alloys of trade name INCONEL 600 were treated at room temperature for 16 hours with a solution of 0.1 mol of chromic acid and 0.004 mol of potassium permanganate. After intermediate rinsing, a decontamination factor of only 1.2 was found. After a further treatment at room temperature with an aqueous solution of 0.1 mol of oxalic acid for 6 hours under the action of ultrasonics, a decontamination factor of 12 was determined.

EXAMPLE 3

Samples a) of ferritic chromium steel, samples b) of austenitic stainless steels and samples c) of INCOLOY 800 and of INCONEL 600 were each treated for 16 hours at room temperature in aqueous solutions with 0.01 to 0.1 mol of chromic acid and 0.001 to 0.05 mol of permanganic acid, the chromic acid/permanganic acid ratio being between 1:10 and 25:1. The samples were then each further treated for 6 hours at room temperature in an aqueous solution of 0.1 mol of oxalic acid under the action of ultrasonics. Finally, decontamination factors of between 10 and 1000 were measured on all the samples, depending on the oxidative treatment and on the sample material.

EXAMPLE 4

Samples a) of ferritic chromium steel and samples c) of INCONEL 600 were each treated for 16 hours at room temperature in a solution of 0.1 mol of chromic acid and 0.05 mol of permanganic acid. After a subsequent treatment with a water jet of 2.4 kbar (240 Pa) pressure at a treatment rate of 3.6 $m^2$/hour, decontamination factors of about 30 were measured on the samples a) of ferritic chromium steel, and decontamination factors of more than 100 on the samples c) of INCONEL 600. Extensive further investigations showed that the surfaces of the base materials were not attacked by these treatments.

EXAMPLE 5

Samples c) of INCONEL 600 were sprayed for 16 hours at room temperature with a solution of 0.05 mol of chromic acid and 0.002 mol of permanganic acid. After a subsequent further treatment with a water jet as in Example 4, decontamination factors of between 20 and 80 were determined.

EXAMPLE 6

A paste was prepared from an aqueous solution of 0.4 mol of chromic acid and 0.1 mol of permanganic acid by addition of a thickener which is available on the market under the trade name AEROSIL (registered trademark of Degussa). This paste was spread on the contaminated surfaces of samples a) of ferritic chromium steel. After a period of action of 16 hours, the samples were treated with a water jet as in Example 4. The resulting decontamination factors were between 5 and 15.

The tests described by way of example and further extensive investigations showed that the materials normally used in reactor construction for the cooling circuits are not damaged by the treatments using the process according to the invention, irrespective of whether the components decontaminated in this way have aged or have been heat-treated, welded or deformed.

I claim:

1. Process for the decontamination of surfaces, in particular on components of cooling circuits of nuclear reactors, by treatment of the radioactively contaminated surface layers with an aqueous acid-containing decontamination solution, comprising a first treatment step of treating the contaminated surface layers with an aqueous decontamination solution, including chromic acid and permanganic acid or salts thereof, at a temperature in the range from 270 K. to 350 K., and a second treatment step of removing the treated surface layers by a chemical treatment in the same temperature range and/or by a physical treatment.

2. Process according to claim 1, wherein the decontamination solution in the first treatment step includes 0.01 to 0.5 mol of chromic acid and 0.001 to 0.1 mol of permanganic acid, the chromic acid/manganic acid ratio being in the range from 1:10 to 25:1.

3. Process according to claim 1, which comprises carrying out the first treatment step for 1 to 20 hours, preferably for about 10 hours.

4. Process according to claim 1, which comprises squirting or spraying the decontamination solution during the first treatment step onto the surface layers to be treated.

5. Process according to claim 1, which comprises, in the first treatment step, applying the decontamination solution as a foam or thixotropic phase to the surface layers to be treated.

6. Process according to claim 1, which comprises adding a thickener to the decontamination solution and, in the first treatment step, applying the decontamination solution with the added thickener as a coating to the surface layers to be treated.

7. Process according to claim 1, which comprises preparing the decontamination solution used in the first treatment step from chromic acid and permanganates.

8. Process according to claim 1, which comprises, in the second treatment step, treating the surface layers with an aqueous solution of at least one organic acid.

9. Process according to claim 8, wherein the solution used in the second treatment step includes about 0.1 mol of oxalic acid.

10. Process according to claim 8, which comprises adding reducing agents and, if appropriate, further components, such as complexing agents and/or corrosion inhibitors, to the acid solution used in the second treatment step.

11. Process according to claim 1, which comprises, in the second treatment step, adding reducing agents to the decontamination solution used in the first treatment step, for reducing the higher oxidation states of the manganese and of the chromium.

12. Process according to claim 11, which comprises adding further components, preferably organic acids and/or complexing agents to the decontamination solution, to which reducing agents have been added for removing the surface layers.

13. Process according to claim 8, which comprises continuously or intermittently purifying the solution by means of a cation exchanger during the second treatment step.

14. Process according to claim 8, which comprises, subsequently to the second treatment step, circulating the solution over an ion exchanger for rinsing the treated surface.

15. Process according to claim 8, which comprises carrying out the second treatment step for 15 minutes to 8 hours.

16. Process according to claim 8, which comprises, in the second treatment step, squirting or spraying the solution onto the surface layers.

17. Process according to claim 8, which comprises, in the second treatment step, applying the solution as a foam or thixotropic phase to the surface.

18. Process according to claim 8, which comprises adding a thickener to the decontamination solution and, in the second treatment step, applying the solution with the added thickener as a coating to the surface layers.

19. Process according to claim 1, which comprises removing the surface layers mechanically or hydraulically in the second treatment step.

* * * * *